US009863412B2

(12) United States Patent
Blackburn

(10) Patent No.: US 9,863,412 B2
(45) Date of Patent: Jan. 9, 2018

(54) ROCKING PISTON COMPRESSOR WITH SOUND DISSIPATION

(71) Applicant: GAST MANUFACTURING, INC., Benton Harbor, MI (US)

(72) Inventor: Christopher Lee Blackburn, St. Joseph, MI (US)

(73) Assignee: GAST MANUFACTURING, INC., Benton Harbor, MI (US)

( * ) Notice: Subject to any disclaimer, the term of this patent is extended or adjusted under 35 U.S.C. 154(b) by 724 days.

(21) Appl. No.: 14/089,148

(22) Filed: Nov. 25, 2013

(65) Prior Publication Data

US 2014/0147300 A1 May 29, 2014

Related U.S. Application Data

(60) Provisional application No. 61/730,594, filed on Nov. 28, 2012.

(51) Int. Cl.

| | |
|---|---|
| ***F04B 39/00*** | (2006.01) |
| ***F04B 39/12*** | (2006.01) |
| ***F04C 29/12*** | (2006.01) |
| ***F04C 29/06*** | (2006.01) |

(52) U.S. Cl.

CPC ..... *F04B 39/125* (2013.01); *F04B 39/122* (2013.01); *F04C 29/06* (2013.01); *F04C 29/065* (2013.01); *F04C 29/068* (2013.01); *F04C 29/12* (2013.01); *F04C 29/124* (2013.01)

(58) Field of Classification Search

CPC .. F04B 11/00; F04B 11/0091; F04B 39/0027; F04B 39/0033; F04B 39/0055; F04B 39/0061; F04B 39/123; F04B 53/001; F04B 53/007; F04B 53/16; F04C 29/06; F04C 29/065; F04C 29/068; F04C 29/12; F04C 29/124

USPC ..... 417/312

See application file for complete search history.

(56) References Cited

U.S. PATENT DOCUMENTS

| | | | | |
|---|---|---|---|---|
| 3,572,970 | A | 3/1971 | Smuland | |
| 6,331,101 | B2 * | 12/2001 | Leu | 417/415 |
| 6,790,019 | B1 * | 9/2004 | Hinchey, Jr. | F04C 29/065 418/15 |
| 6,832,900 | B2 * | 12/2004 | Leu | F04B 27/005 417/415 |

(Continued)

*Primary Examiner* — Essama Omgba
*Assistant Examiner* — Stephen Mick
(74) *Attorney, Agent, or Firm* — Tucker Ellis LLP; Heather M. Barnes; Michael G. Craig

(57) ABSTRACT

Dual cylinder and single cylinder rocking piston compressors with sound attenuation are disclosed. Due to the tapered shape of the intake and exhaust chamber sides and tops, the gas flow is accelerated and decelerated through the compressors thereby allowing sound energy to be dissipated. Sound attenuation is further enhanced by the addition of baffles, which divide each chamber into a series of smaller attenuation chambers. The baffles also cause the gas flow to accelerate and decelerate as the gas flow passes the baffles. In the case of a dual cylinder rocking piston compressor, enlarging the crossover passageway diameters also creates additional sound attenuation chambers, which contribute to the overall reduction in sound. Further, by using dedicated seals for each intake in the exhaust chamber, flow leakage at higher pressures is decreased, thereby improving compressor efficiencies.

8 Claims, 11 Drawing Sheets

(56) References Cited

U.S. PATENT DOCUMENTS

| | | | | |
|---|---|---|---|---|
| 8,246,327 | B2 | 8/2012 | Otte, Jr. et al. | |
| 2004/0052653 | A1 * | 3/2004 | Kubota | F04B 39/0061 417/312 |

* cited by examiner

ROCKING PISTON COMPRESSOR WITH SOUND DISSIPATION

BACKGROUND

Technical Field

This disclosure is directed to rocking piston compressors or pumps and, more specifically, to rocking piston compressors or pumps with sound dissipation qualities that result in both a quieter operation and higher efficiency at high operating duties.

Description of the Related Art

Rocking piston or reciprocating compressors generally include one or two pistons, which reciprocate within one or two cylinders respectively. Dual cylinder rocking piston compressors, for example, include a pair of valve plates that cover the two cylinders, and a pair of heads that cover the valve plates, leaving intake and exhaust chambers or spaces between the heads and valve plates. Typically, each head may include at least one intake port and at least one exhaust port. For a compressor having both cylinders working in parallel, communication between the intake chambers of each head/valve plate and between the exhaust chambers of each head/valve plate is provided by two crossover passageways or conduits. For a compressor having both cylinders working in series (or "staged operation"), communication between the exhaust chamber of the first head/valve plate portion and between the intake chamber of the second head/valve plate portion is provided by one crossover passageway or conduit. Further, some designs employ a single-piece valve plate body and some designs employ a single-piece head. The gas or air flows into the compressor though the intake and is directed into the cylinders through valved inlet ports in the valve plates. Compressed air or gas is pumped out of the cylinders through valved outlet ports in the valve plates that are in communication with the compressor exhaust.

In many rocking piston compressor applications, compressor noise is an issue. For example, oxygen concentrators typically utilize a dual-cylinder, rocking piston compressor, which must be located near the user (or patient). As a result, it is desirable to minimize the noise produced by the compressor. Of course, there are numerous other applications where rocking piston compressors are appropriate, but noise remains an issue. For example, rocking piston-type compressors are used in other medicinal applications as well as various industrial, scientific and food manufacturing applications.

Accordingly, dual-cylinder (parallel and staged operation) and single-cylinder rocking piston-type compressors are needed that are quieter than currently available designs, without compromising output, performance or efficiency.

SUMMARY OF THE DISCLOSURE

In one aspect, a rocking piston compressor is disclosed. The disclosed compressor may include a valve plate that covers a cylinder. The valve plate may include an inlet and an outlet that are in communication with the cylinder. The disclosed compressor may further include a head coupled to the valve plate. The head and valve plate may define an intake chamber and an exhaust chamber. At least one of the head and valve plate may define an intake and at least one of the head and valve plate may define an exhaust. The intake chamber may be in communication with the intake and the inlet; the exhaust chamber may be in communication with the exhaust and the outlet. The head may slope towards the valve plate as the head extends from one end of the valve plate towards the other end of the valve plate. The intake chamber may increase in cross-sectional area as the intake chamber extends from the intake to the inlet. Further, the exhaust chamber may decrease in size as the exhaust chamber extends from the outlet to the exhaust.

In a refinement, the head and valve plate may define an intake sound attenuation chamber that may be in communication with the intake chamber with an intake baffle disposed therebetween that restricts communication between the intake sound attenuation chamber and intake chamber.

In another refinement, the head and valve plate may further define an exhaust sound attenuation chamber that may be in communication with the exhaust chamber with an exhaust baffle disposed therebetween that restricts communication between the exhaust sound attenuation chamber and the exhaust chamber.

In a refinement, the intake may pass through the valve plate.

In another refinement, the exhaust may pass through the valve plate.

In another refinement, the intake and exhaust may pass through the valve plate.

In another refinement, the head may include a plurality of pluggable ports in communication with at least one of the intake chamber and the intake sound attenuation chamber, and the head may also include a plurality of pluggable ports in communication with at least one of the exhaust chamber and the exhaust sound attenuation chamber.

In another refinement, the intake baffle may be disposed between the intake port and the inlet.

In another refinement, the exhaust baffle may be disposed between the outlet and the exhaust port.

In another refinement, cross-sectional area of the intake chamber may increase between the intake port and the inlet.

In another refinement, a cross-sectional area of the exhaust chamber may decrease between the outlet and the exhaust port.

In another refinement, the intake and exhaust chambers may each be circumscribed by chamber seals that are sandwiched between the valve plate and the head.

In another aspect, a dual rocking piston compressor is disclosed. The disclosed dual rocking piston compressor may include a valve plate body that may include two valve plates coupled together by an intake crossover passageway and an exhaust crossover passageway. The compressor may further include two cylinders with each valve plate covering one of the cylinders. Each valve plate may include an inlet and an outlet in communication with its respective cylinder. The compressor may further include two heads with each head covering one of the valve plates. Each head and valve plate may define an intake chamber and an exhaust chamber. Each intake chamber may be in communication with the inlet of its respective valve plate. Each exhaust chamber may be in communication with the outlet of its respective valve plate. The intake chambers may be in communication with each other via the intake crossover passageway. The exhaust chambers may be in communication with each other via the exhaust crossover passageway. One of the heads and valve plates may be in communication with an intake and the other of the heads and valve plates may be in communication with an exhaust. The intake crossover passageway may include an inlet and an outlet and a passageway chamber disposed therebetween. The exhaust crossover passageway may also include an inlet and an outlet and a passageway chamber disposed therebetween. In addition, a cross-sectional area of the each passageway chamber between its respective inlet and outlet is greater than a minimum cross-sectional area at either its respective inlet or its respective outlet.

In a refinement, each head and valve plate may define an intake sound attenuation chamber in communication with its respective intake chamber with an intake baffle disposed therebetween. Similarly, each head and valve plate may further define an exhaust sound attenuation chamber in communication with its respective exhaust chamber with an exhaust baffle disposed therebetween. The intake baffles may provide restrictive communication between the intake sound attenuation chambers and the intake chambers. The exhaust baffles may provide restrictive communication between the exhaust sound attenuation chambers and the exhaust chambers.

In a refinement, the intake and exhaust crossover passageways are disposed at least partially below the intake chambers and the exhaust chambers.

In another refinement, each head may include a plurality of pluggable intake ports that are communication with at least one their respective intake chamber and sound attenuation chamber, and each head may further include a plurality of pluggable exhaust ports that are communication with at least one their respective exhaust chamber and exhaust sound attenuation chamber.

In another refinement, each crossover passageway may include an inlet and an outlet and a passageway chamber disposed therebetween, and a cross-sectional area of the each passageway chamber between its respective inlet and outlet may be greater than a minimum cross-sectional area at either its respective inlet or its respective outlet. The increased cross-sectional area of each passageway chamber converts the passageway chambers into sound attenuation chambers.

In another refinement, each intake chamber may be circumscribed by an intake chamber seal that is sandwiched between its respective valve plate and head, and each exhaust chamber may be circumscribed by an exhaust chamber seal that is sandwiched between its respective valve plate and head.

In another refinement, each head and valve plate may further define a pair of intake sound attenuation chambers with the intake chamber disposed therebetween and with a pair of intake baffles providing restrictive communication between the intake sound attenuation chambers and the intake chambers, and each head and valve plate may further define a pair of exhaust sound attenuation chambers with the exhaust chamber disposed therebetween and with a pair of exhaust baffles providing restrictive communication between the exhaust sound attenuation chambers and the exhaust chambers.

In another refinement, each intake chamber may expand in cross-sectional area as each intake chamber extends from the intake towards one of its respective inlet.

In another refinement, each intake chamber may contract in cross-sectional area as each intake chamber extends from its respective inlet towards the intake crossover passageway.

In another refinement, each exhaust chamber may contract in cross sectional area as each exhaust chamber extends from its respective outlet towards the exhaust crossover passageway.

In another refinement, each exhaust chamber may contract in cross sectional area as each exhaust chamber extends from its respective outlet towards exhaust.

In another aspect, a rocking piston compressor is disclosed that includes a valve plate body that may include a first valve plate coupled to a second valve plate body an intake crossover passageway and an exhaust crossover passageway. The first valve plate may cover a first cylinder and the second valve plate may cover a second cylinder. The first valve plate may include a first inlet and a first outlet in communication with the first cylinder while the second valve plate may include a second inlet and a second outlet in communication with the second cylinder. The compressor may further include a first head, a second head, an intake port and an exhaust port. The first head may be coupled to the first valve plate and may define a first intake chamber with the first valve plate. The first intake chamber may provide communication between the intake port, the first inlet and the intake crossover passageway. The first head and first valve plate may further define a first exhaust chamber that may provide communication between the first outlet and the exhaust crossover passageway. Meanwhile, the second head may cover the second valve plate and may define a second intake chamber with the second valve plate. The second intake chamber may provide communication between the intake crossover passageway and the second inlet. The second head and second valve plate may further define a second exhaust chamber that may provide communication between the exhaust crossover passageway, the second outlet and the exhaust port. The intake and crossover passageways may be disposed below the first and second intake chambers and the first and second exhaust chambers.

In a refinement, the second intake chamber may be in communication with a first additional port that may be plugged and the first exhaust chamber may be in communication with a second additional port that is plugged.

In any one or more of the embodiments described above, each crossover passageway may include an inlet and an outlet and a passageway chamber disposed therebetween. A cross sectional area of each passageway chamber between its respective inlet and outlet may be greater than a minimum cross-sectional area at either its respective inlet or its respective outlet. The increased cross-sectional area of each passageway chamber converts the passageway chambers into sound attenuation chambers.

In any one or more of the embodiments described above, the first intake chamber may be isolated from the first exhaust chamber by at least one first seal that may be sandwiched between the first valve plate and the first head. Further, the second intake chamber may be isolated from the second exhaust chamber by at least one second seal that may be sandwiched between the second valve plate and the second head.

In any one or more of the embodiments described above, the first intake cylinder may be circumscribed by a first intake chamber seal. The second intake chamber may be circumscribed by a second intake chamber seal. The first exhaust chamber may be circumscribed by a first exhaust chamber seal and the second exhaust chamber may be circumscribed by a second exhaust chamber seal. Thus, four dedicated seals are utilized to isolate the first exhaust chamber from the first intake chamber and the second exhaust chamber from the second intake chamber.

In any one or more of the embodiments described above, the compressor may include baffles that divide each of the first and second intake chambers and each of the first and second exhaust chambers into at least two sound attenuation chambers.

In any one or more of the embodiments described above, the compressor may further include baffles that divide each of the first and second intake chambers and each of the first and second exhaust chambers into at least three sound attenuation chambers.

In any one or more of the embodiments described above, the first intake chamber may expand in cross-sectional area as the first intake chamber extends from the intake port towards the first inlet before contracting in cross-sectional area as the first intake chamber extends from the first inlet towards the intake crossover passageway.

In any one or more of the embodiments described above, the first intake chamber may include at least one baffle.

In any one or more of the embodiments described above, the first intake chamber may include at least one baffle between the intake port and the first inlet and at least one baffle between the first inlet and the intake crossover passageway.

In any one or more of the embodiments described above, the second intake chamber may expand in cross-sectional area as the second intake chamber extends from the intake crossover passageway towards the second inlet.

In any one or more of the embodiments described above, the second intake chamber may include at least one baffle.

In any one or more of the embodiments described above, the second intake chamber may include at least one baffle disposed between the intake crossover passageway and the second inlet.

In any one or more of the embodiments described above, the first exhaust chamber may contract in cross-sectional area as the first exhaust chamber extends from the first outlet towards the exhaust crossover passageway.

In any one or more of the embodiments described above, the first exhaust chamber may include at least one baffle.

In any one or more of the embodiments described above, the first exhaust chamber may include at least one baffle disposed between the first outlet and the exhaust crossover passageway.

In any one or more of the embodiments described above, the second exhaust chamber may expand in cross-sectional area as the second exhaust chamber extends from the exhaust crossover passageway towards the second outlet before contracting in cross-sectional area as the second exhaust chamber extends from the second outlet towards the exhaust port.

In any one or more of the embodiments described above, the second exhaust chamber includes at least one baffle.

In any one or more of the embodiments described above, the second exhaust chamber includes at least one baffle disposed between the exhaust crossover passageway and the second outlet and at least one baffle disposed between the second outlet and the exhaust port.

In another aspect, another single cylinder rocking piston compressor is disclosed that may include a cylinder covered by a valve plate. The valve plate may be coupled to a head. The valve plate and the head may define an intake chamber and an exhaust chamber wherein the intake and exhaust chambers are isolated from one another. The intake chamber may be in communication with an intake port while the exhaust chamber may be in communication with an exhaust port. The valve plate may include an inlet that provides communication between the cylinder and the intake chamber. The valve plate may further include an outlet that may provide communication between the cylinder and the exhaust chamber. Further, the compressor may include baffles that divide the intake and exhaust chambers into two or more sound attenuation chambers.

In any one or more of the embodiments described above, the intake chamber may include a baffle disposed between the intake port and the inlet.

In any one or more of the embodiments described above, the exhaust chamber may include a baffle disposed between the outlet and the exhaust port.

In any one or more of the embodiments described above, a cross-sectional area of the intake chamber may increase as the intake chamber extends between the intake port and the inlet disposed in valve plate.

In any one or more of the embodiments described above, a cross-sectional area of the exhaust chamber may decrease as the exhaust chamber extends between the outlet and the valve plate and the exhaust port.

In any one or more of the embodiments described above, the intake and exhaust chambers may each be circumscribed by chamber seals that are sandwiched between the valve plate and the head.

The disclosed dual and single cylinder rocking piston compressors are both quiet and efficient. The sound dissipation may be achieved by any one or more the following features: a unique shape of the inlet and exhaust chambers that are formed by the assembly of the valve plate and head(s); baffles in the inlet and outlet chambers; and, for dual cylinder compressors (twin displacement designs), unique under-valve plate crossover passageways that connect the intake chambers together and exhaust chambers together for parallel cylinder operation or that connects the intake chamber above one cylinder to the exhaust chamber above the other cylinder and vice versa for staged cylinder operation. Further, use of a dedicated seal for each intake and exhaust chamber decreases leakage from the flow from the intake chamber to the adjacent exhaust chamber at higher pressures, thus improving compressor efficiency. The above features collectively and/or independently may produce a compressor that is quieter across the entire performance range and more efficient at higher duties.

Due to the tapered shape of the intake and exhaust chamber sides and top (or head) as shown in the drawings, intake air flow is accelerated and output air flow is decelerated through the compressor thereby allowing sound energy to be attenuated. Sound attenuation is further enhanced by the addition of baffles, which divide each chamber into a series of smaller attenuation chambers. In each attenuation chamber, the airflow is accelerated and/or decelerated thereby attenuating sound energy and improving sound quality.

In the case of the disclosed dual cylinder compressor, enlarging the valve plate crossover passageway diameters relative to the inlets and outlets to the passageways creates two additional sound attenuation chambers for parallel cylinder operation and one additional sound attenuation chamber for staged cylinder operation, which may also help to reduce sound.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiment illustrated in greater detail on the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
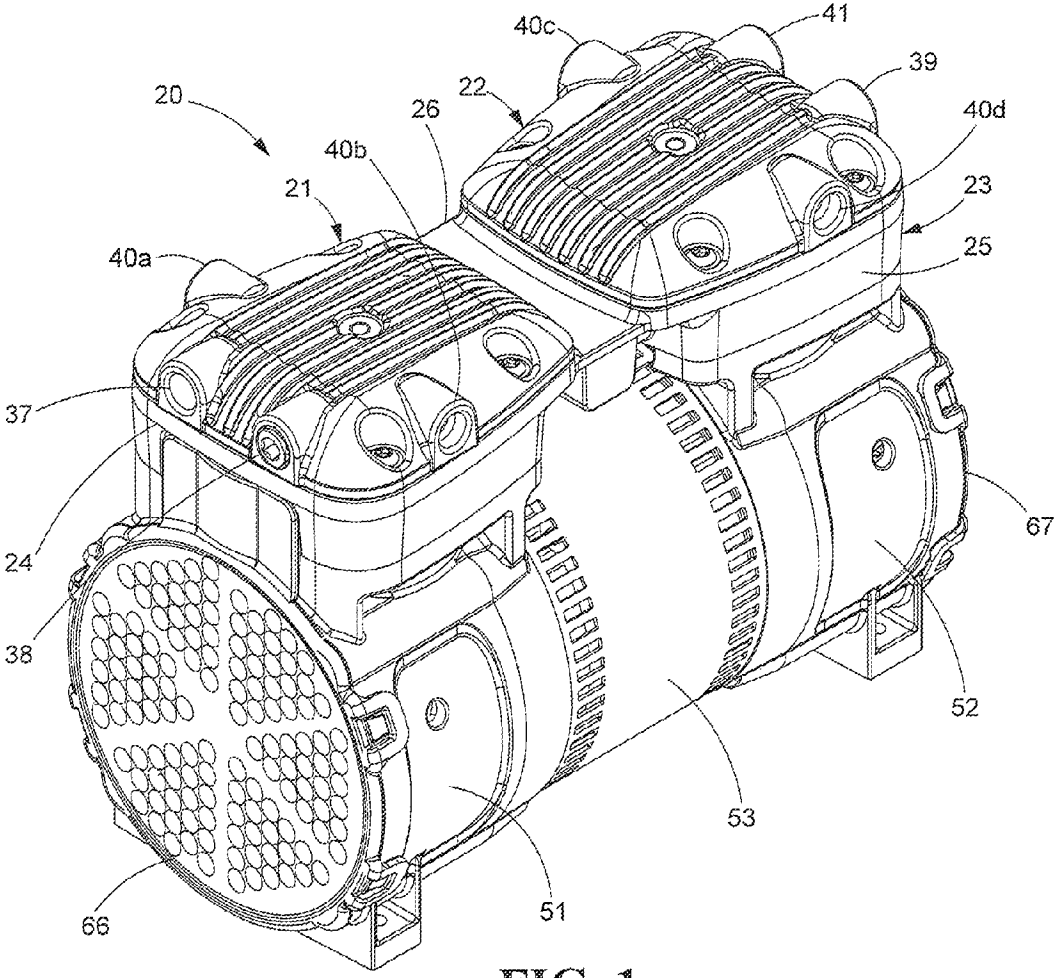
FIG. 1 is a perspective view of a disclosed dual cylinder rocking piston compressor.

FIG. 1 illustrates a disclosed dual cylinder rocking piston-type compressor 20 with two heads 21, 22 that are mounted onto a valve plate body 23 that may include two distinct valve plates 24, 25 that may be coupled together by a crossover passageway housing 26. The two valve plates 24, 25 and crossover passageway housing 26 may be cast together as a single part or individual valve plates 24, 25 may be employed with conduits serving as the crossover passageways (not shown). For example, stiff or flexible tubes may be employed for the intake and exhaust crossover passageways as explained below. In the embodiment shown in FIG. 1, each head 21, 22 slopes towards its respective valve plate 24, 25 respectively as each head 21, 22 extends towards the crossover passageway housing 26. It has been found that this sloping feature of the heads 21, 22 provides for improved flow through the compressor 20 for quieter operation.

Figure 2:
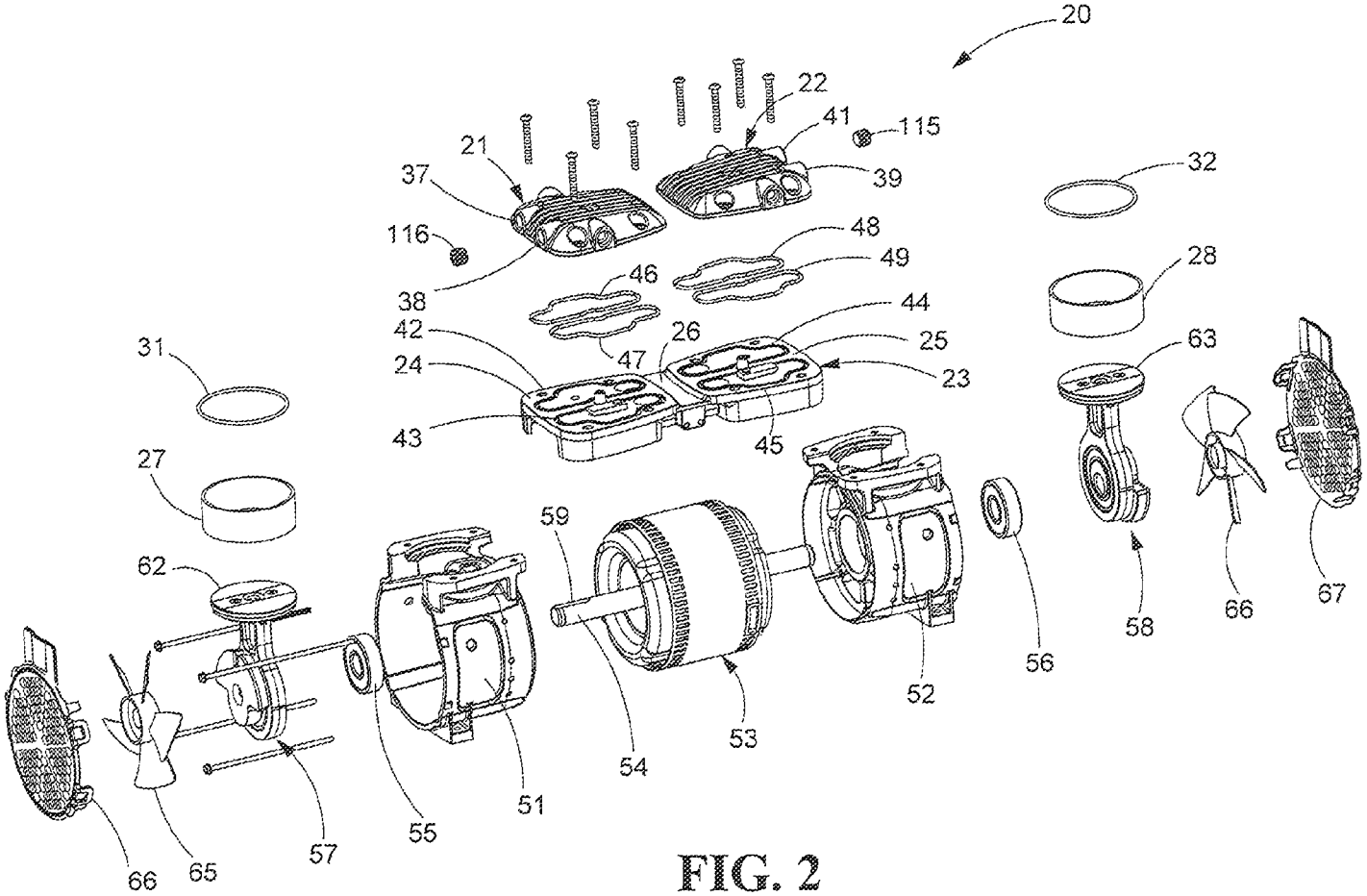
FIG. 2 is an exploded view of the compressor shown in FIG. 1.
Figure 3B:
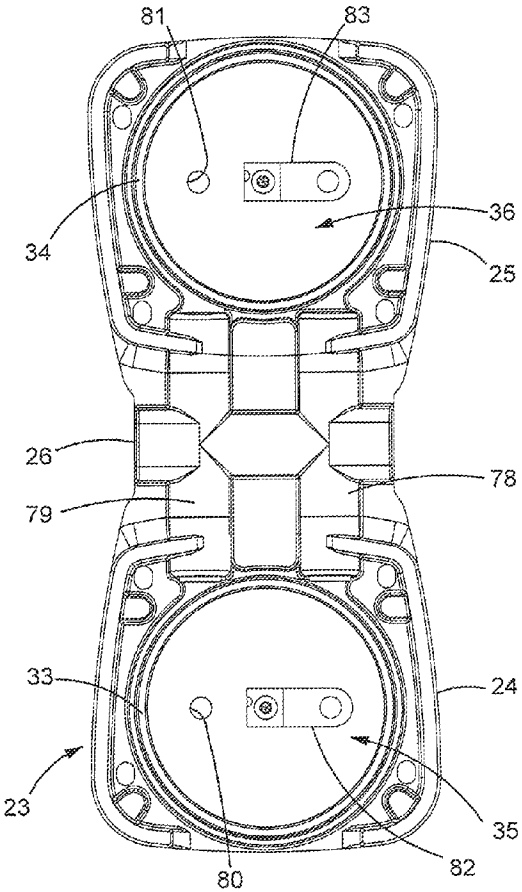
FIG. 3B is bottom view of the valve plate assembly of the compressor shown in FIGS. 1 and 2.
Figure 5B:
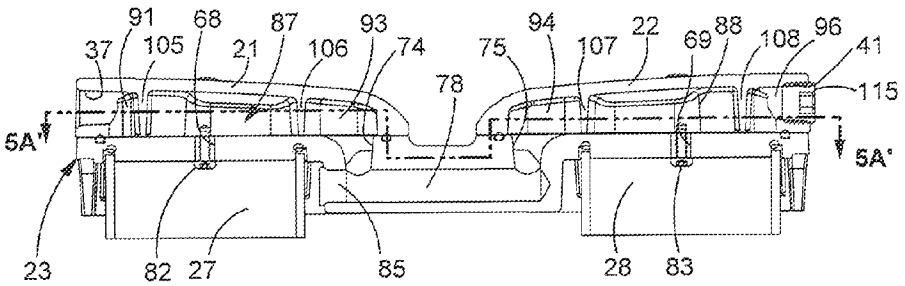
FIG. 5B is a sectional view taken substantially along line 5B-5B of FIG. 5A.
Figure 5C:
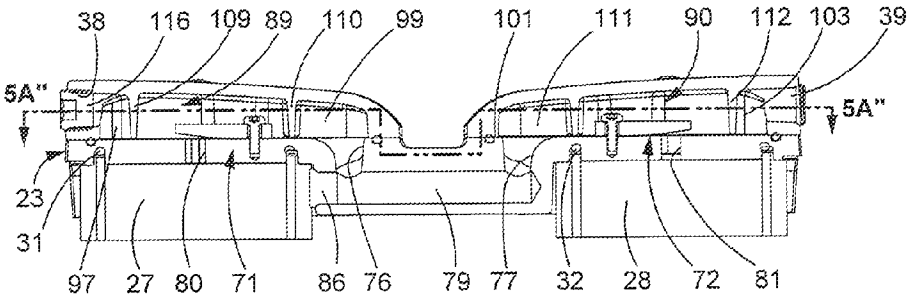
FIG. 5C is a sectional view taken substantially along line 5C-5C of FIG. 5A.

Referring to FIGS. 1 and 2, each valve plate 24, 25 may cover a cylinder 27, 28 respectively with a seal 31, 32 that may be sandwiched between each cylinder 27, 28 and a slot 33, 34 disposed on the underside 35, 36 of each valve plate 24, 25 as shown in FIG. 3B. As shown in FIG. 2, each head may include four ports 37, 38, 40*a*, 40*b* (head 21) and 39, 41, 40*c*, 40*d* (head 22). Only a single port is needed for an intake and only a single port is needed for an exhaust but more than one intake and more than one exhaust may be employed. Therefore, the plurality of ports 37, 38, 40*a*, 40*b*, 39, 41, 40*c*, 40*d* enables the user to employ the compressor 20 in a variety of configurations, as will be apparent to those skilled in the art. In the specific configuration illustrated in FIGS. 1-5C, any one or more of the ports 37, 40*a*, 40*c*, 41 may serve as intake ports (or intakes) and any one or more of the ports 38, 40*b*, 39, 40*d* may serve as exhaust ports (or exhausts). However, in the illustrated configuration, the ports 40*a*, 40*c* and 41 are plugged while the port 37 is unplugged and therefore the port 37 serves as a single intake for the compressor 20. Further, because the ports 38, 40*b*, 40*d* are plugged while the port 39 is unplugged, the port 39 serves as a single exhaust for the compressor in the configuration illustrated in FIGS. 1-5C. However, as shown in FIGS. 5B and 5C, the flow path may be easily reversed by removing the plugs 115, 116 from the ports 38, 41 and placing the plugs 115, 116 in the ports 37, 39 thereby enabling the port 41 to serve as the intake and the port 38 to serve as the exhaust (assuming that the side ports 40*a*, 40*b*, 40*c*, 40*d* are plugged). Additionally, the intake and exhaust sides may be reversed by switching the positions of the outlet valves 71, 72 and the inlet valves 82, 83 (see FIGS. 3A-3B). Thus, the compressor 20 is capable of multiple configurations.

As shown in FIGS. 2 and 5B, the valve plates 24, 25 may each include a slot 42, 44 that each may define intake chambers 87, 88 with the heads 21, 22 respectively. Each valve plate 24, 25 may also include slots 43, 45 that each may define exhaust chambers 89, 90 with the heads 21, 22 respectively as shown in FIG. 5C. The slots 42-45 may each accommodate a dedicated seal 46, 47, 48, 49 respectively (FIG. 2). The intake chambers 87, 88 and exhaust chambers 89, 90 along with the various sound attenuation chambers 91, 93, 94, 96, 97, 99, 101, 103 will be described in greater detail below.

Returning to FIG. 2, each cylinder 27, 28 may be disposed within a housing 51, 52 that may be disposed on either side of a motor 53 which rotates the drive shaft 54. The drive shaft 54 may pass through bearings 55, 56 before being coupled to the rocking pistons assemblies 57, 58 which are coupled to the drive shaft 54 by the engagement of a set screw (not shown) extending from the rocking piston assemblies 57, 58 to flats or slots disposed on the motor shaft (only one of which is shown at 59 in FIG. 2). The reader will note from FIG. 2 that the rocking piston assemblies 57, 58 are 180° out of phase with each other, meaning that when one piston assembly 57 is performing an exhaust stroke, the other piston assembly 58 is performing an intake stroke and vice versa. Each rocking piston assembly 57, 58 may include piston heads 62, 63 that are slidably and sealably received within the cylinders 27, 28 respectively. Fans 65, 66 may be disposed between the pistons 57, 58 and the ventilated covers 66, 67 respectively for cooling purposes.

Figure 3A:
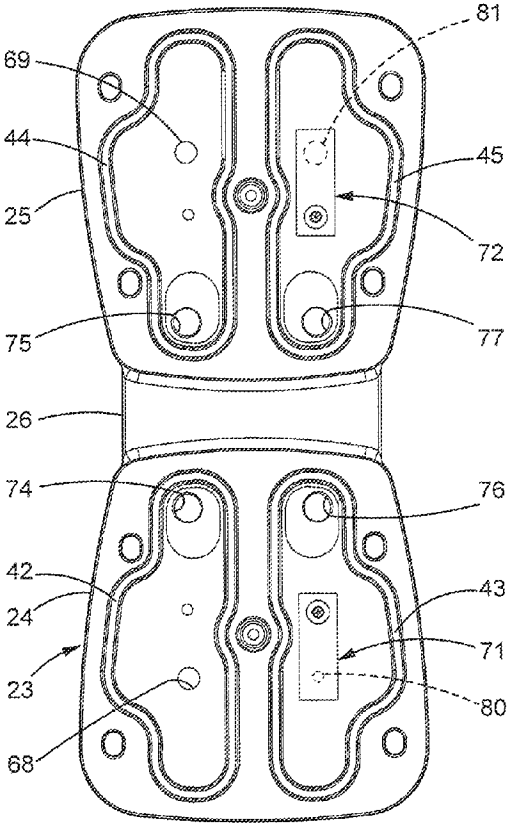
FIG. 3A is top view of the valve plate assembly of the compressor shown in FIGS. 1 and 2.
Figure 4:
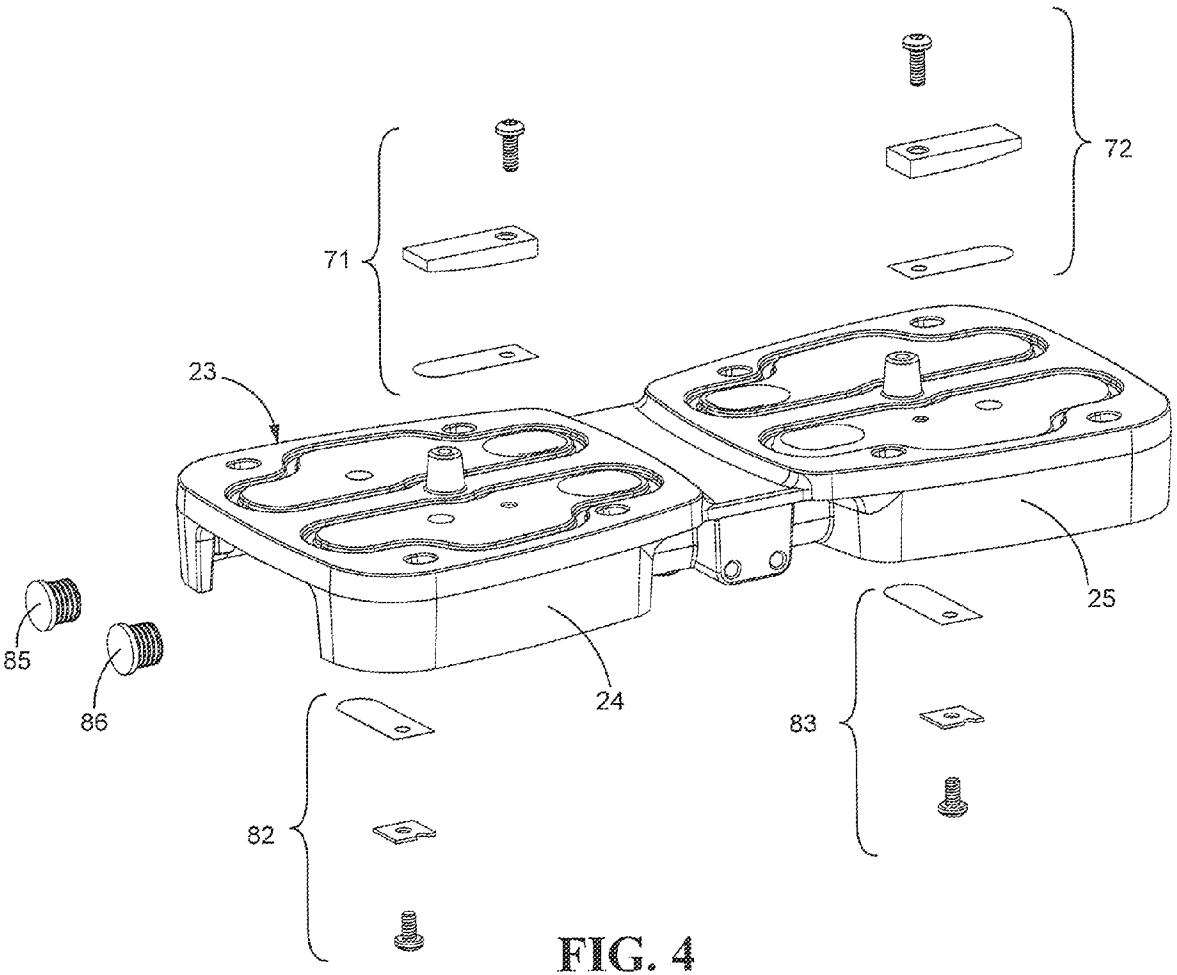
FIG. 4 is an exploded view of the valve plate assembly shown in FIGS. 3A and 3B.

The top and bottom sides of the valve plate body 23 and the two valve plates 24, 25 are illustrated in FIGS. 3A-3B respectively. FIG. 3A shows the inlet 68 of the valve plate 24 which leads to the cylinder 27 while FIG. 3B shows the inlet valve 82 of the valve plate 24 disposed beneath the inlet 68 and within an upper portion of the cylinder 27. Similarly, FIG. 3A shows the inlet 69 of the valve plate 25 which leads to the cylinder 28 while FIG. 3B shows the inlet valve 83 disposed beneath the inlet 69 and within an upper portion of the cylinder 28. FIG. 3A also shows the exhaust valve 71 for the valve plate 24 and the cylinder 27 as well as the exhaust valve 72 for the valve plate 25 and the cylinder 28. FIG. 3A further shows an inlet 74 of the intake crossover passageway 78 (FIGS. 3B and 5B) as well as an outlet 75 of the intake crossover passageway 78. FIG. 3A also shows an inlet 76 of the exhaust crossover passageway 79 (FIGS. 3B and 5C) and an outlet 77 of the exhaust crossover passageway 79.

FIG. 3B illustrates the crossover passageway housing 26 for the intake and exhaust crossover passageways 78, 79. FIG. 3B also shows the inlet valve 82 disposed beneath the inlet 68 that leads to the cylinder 27 and the inlet valve 83 disposed beneath the inlet 69 that leads to the cylinder 28. An exploded view of the valve plate body 23, the exhaust valve 71, the inlet valve 82, and the inlet valve 83 is provided in FIG. 4. The plugs 85, 86 seal one end of each crossover passageway 78, 79 respectively as shown in FIGS. 5B-5C.

Figure 5A:
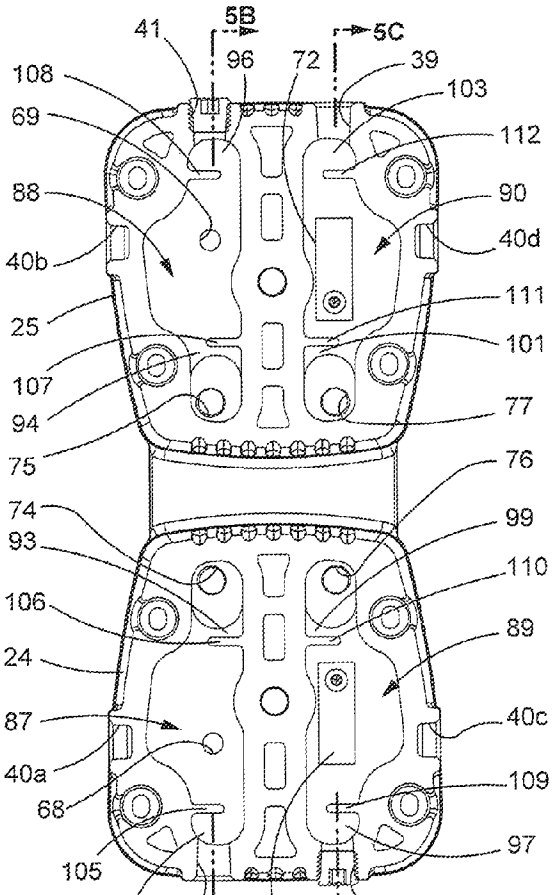
FIG. 5A is a sectional view taken substantially along lines 5A'-5A' of FIGS. 5B and 5A"-5A" of FIG. 5C.
Figure 6B:
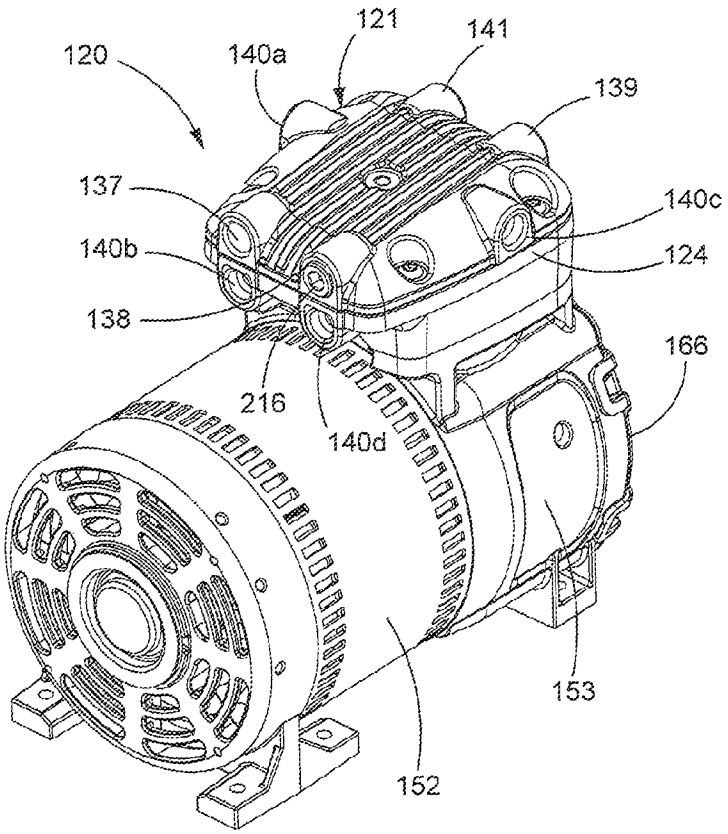
FIGS. 6A and 6B are perspective views of a disclosed single cylinder rocking piston compressor with multiple intake and exhaust ports for multiple configurations.
Figure 6A:
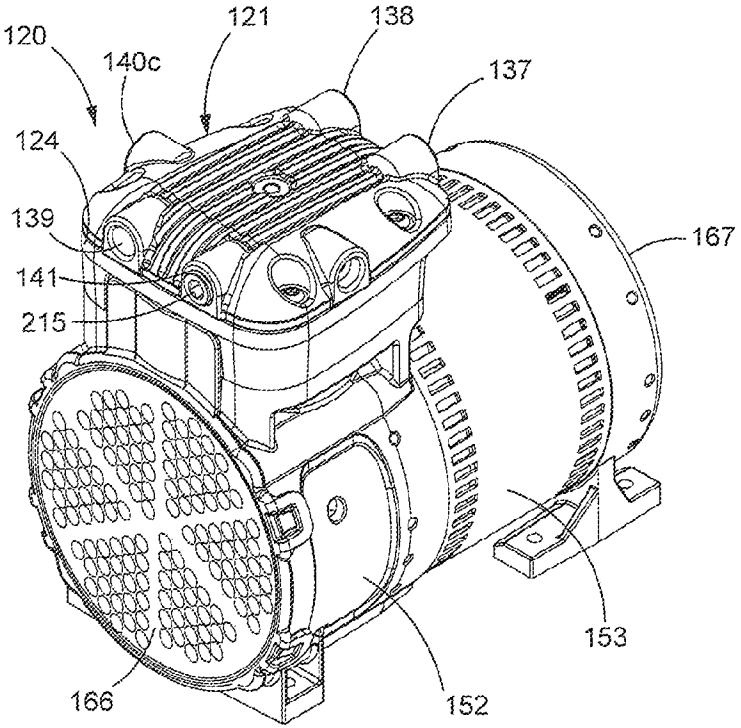

FIGS. 5A-5C illustrate the flow of air or gas through the chambers 87-90, 91, 93-94, 96, 97, 99, 101, 103 that are defined by the valve plate body 23 and the heads 21, 22. As noted above and shown in FIGS. 5B and 5C, the first and second valve plates 24, 25 and the heads 21, 22 may define first and second intake chambers 87, 88 respectively and first and second exhaust chambers 89, 90 respectively. The first and second intake chambers 87, 88 and the first and second exhaust chambers 89, 90 may be in communication with one or more sound attenuation chambers 91, 93 (intake chamber 87), 94, 96 (intake chamber 88), 97, 99 (exhaust chamber 89) and 101, 103 (exhaust chamber 90) via the baffles 105-112 as best seen in FIG. 5A.

As shown in FIG. 5B, air or gas enters the compressor 20 through the intake 37 before it passes through the sound attenuation chamber 91 and past the baffle 105 before it enters the intake chamber 87. The air or gas flows from the intake chamber 87, past the baffle 106 before entering the sound attenuation chamber 93 and the crossover passageway inlet 74, which directs the air or gas into the crossover passageway 78. The crossover passageway outlet 75 permits said air or gas to flow from the crossover passageway 78 through the sound attenuation chamber 94, past the baffle 107 and into the other intake chamber 88. As the air or gas flows through the intake side of the compressor 20, it is drawn downward through the inlets 68, 69 and into the cylinders 27, 28 where it is compressed.

Conversely, as shown in FIG. 5C, air exits the compressor through the outlets 80, 81 before entering the exhaust chambers 89, 90. The crossover passageway inlet 76 receives air or gas from the exhaust chamber 89 after it passes the baffle 110 and after it passes through the sound attenuation chamber 99 before it is directed into the crossover passageway 79. The outlet 77 communicates the air or gas from the crossover passageway 79 into the sound attenuation chamber 101, past the baffle 111 and into the exhaust chamber 90. The air or gas then passes the baffle 112, proceeds through the sound attenuation chamber 103 and exits the compressor 20 through the exhaust port 39.

The additional port 41 may be sealed by the plug 115 and the additional port 38 may be sealed by the plug 116. However, as noted above, the direction of the flow may be reversed by using the port 41 as a single intake and the port 38 as a single exhaust. The side ports 40*a*, 40*b*, 40*c*, 40*d* may also be plugged, used as auxiliary intakes (ports 40*a*, 40*b*), auxiliary exhausts (ports 40*c*, 40*d*) or as single intakes or exhausts, depending on the desired configuration. As will be apparent to those skilled in the art, multiple configurations are available and an exhaustive list need not be mentioned here.

Still referring to FIGS. 5B-5C, the crossover passageways 78, 79 may be drilled and plugs 85, 86 may be used to seal the open ends of the crossover passageways caused by the drilling operation.

The flow through the compressor 20 for the illustrated configuration may be described in connection with FIGS. 5A-5C. The first intake chamber 87 may be a sound attenuation chamber itself and may be in communication with one or more sound attenuation chambers 91, 93. Gas/air flows through the intake port 37 and into the sound attenuation chamber 91 before passing the baffle 105 and entering the intake chamber 87 before passing the baffle 106 and entering the sound attenuation chamber 93. The air/gas then proceeds through the inlet 74 to the crossover passageway 78 before exiting through the outlet 75 and entering the sound attenuation chamber 94. The air or gas passes the baffle 107 before reaching the second intake chamber 88. The intake chamber 88 may also be in communication with the sound attenuation chamber 96 in addition to the sound attenuation chamber 94. In the first intake chamber 87, part of the air/gas proceeds through the inlet 68 and past the inlet valve 82 before it is compressed in the cylinder 27. In the second intake chamber 88, part of the air/gas also proceeds through the inlet 69 and past the inlet valve 83 before it is compressed in the cylinder 28.

After the air/gas is compressed in the cylinder 27, it passes upward through the outlet 80 and exhaust valve 71 and into the first exhaust chamber 89. The air then proceeds past the baffle 110, through the sound attenuation chamber 99 and through the inlet 76 to the crossover passageway 79 before exiting the crossover passageway through the outlet 77 and entering the sound attenuation chamber 101. The air/gas then passes the baffle 111 before entering the second exhaust chamber 90. Additional air/gas exits the cylinder 28 through the outlet 81 and exhaust valve 72 before entering the second exhaust chamber 90 and passing the baffle 112 as it enters the sound attenuation chamber 103 before it exits through the exhaust port 39.

The reader will note that as air/gas enters the intake 37 and expands in the sound attenuation chamber 91 before it is compressed as it passes the baffle 105. The air/gas expands again in the larger intake chamber 87 (see FIG. 5A). The increases and decreases in volume and/or pressure as the air passes through the intake port 37, through the sound attenuation chamber 91, past the baffle 105 and into the larger intake chamber 87 provides a sound attenuation effect. The air/gas is then compressed again as it proceeds past the baffle 106 before expanding as it proceeds through the sound attenuation chamber 93 and onto the inlet 74. In addition to the sound attenuation provide by the chamber 93, the cross-sectional diameter of the crossover passageway 78 is larger than the minimum diameter of the inlet 74, which causes the air/gas to expand again thereby providing the crossover passageway 78 with sound attenuation effects as well. As the air proceeds through the narrow portion of the outlet 75, it expands as it enters the sound attenuation chamber 94. As air passes the baffle 107, it is compressed again before entering the large intake chamber 88, which also provides a sound attenuation effect before the air/gas enters the cylinder 28 through the inlet 69. The valve plate 25 may include the baffle 108 to form a sound attenuation chamber 96 when the additional port 41 is used as the intake.

Similarly, referring to FIG. 5C, as air exits the cylinder 27, it passes through the exhaust valve 71 and expands in the exhaust chamber 89 before being compressed as it flows past the baffle 110 before expanding yet again as it enters the sound attenuation chamber 99. Then, the air/gas passes through the relatively narrow inlet 76 and into the crossover passageway 79 which has a larger diameter than the minimum diameter of the inlet 76 thereby providing a sound attenuation effect for the crossover passageway 79. The air/gas then contracts as it enters the outlet 77 before expanding as it enters the sound attenuation chamber 101 before being compressed as it passes the baffle 111. The air/gas then expands again as it enters the exhaust chamber 90. Air/gas exits the cylinder 28 through the exhaust valve 72 and into the exhaust chamber 90 before being compressed as it passes the baffle 112 and enters the final sound attenuation chamber 103 before exiting through the exhaust port 39.

Without being bound by theory, it is believed that the various disclosed sound attenuation chambers, intake chambers exhaust chambers and sloping heads, in combination with the baffles, provide expansion and compression of the air/gas as it proceeds through the sound attenuation chambers (and intake and exhaust chambers) and past the baffles before exiting through the exhaust port provides significant sound attenuation properties. These improved sound attenuation properties are presented in FIG. 11 where the line 300 represents the sound level of a conventional dual cylinder rocking piston type compressor and the line 301 represents the sound level of the disclosed dual cylinder rocking piston-type compressor 20.

A single cylinder rocking piston compressor 120 is illustrated in FIGS. 6A-10C. The compressor 120 includes a head 121 that covers a valve plate 124. The head 121 may include a plurality of ports 137, 138, 139, 141, 140*a*, 140*b*, 140*c*, 140*d*. Like the compressor 20 shown in FIGS. 1-5C, the head 121 slopes towards the valve plate 124 as the head 121 extends from one end of the valve plate 124 to the other end of the valve plate 124. The sloping configuration of the head 121 results in a reduction in the size of the chamber(s) defined by the head 121 and valve plate 124 for improved flow and quieter operation of the compressor 120.

In the configuration illustrated, all of the ports except the intake 137 and exhaust 139 are plugged, but the ports 140*a*, 140*c* and 141 could also serve as intakes and the ports 140*b*, 140*d*, and 138 could also serve as exhausts. Further, the intake and exhaust sides of the compressor 120 may be reversed in addition to the flow direction, as explained above in connection with the compressor 20 of FIGS. 1-5C. Thus, the compressor 120 may assume multiple configurations like the compressor 20 discussed above and each configuration need not be listed here.

To reverse the flow direction of the compressor 120, the plug 215 can be moved from the intake port 141 to seal the exhaust port 139 and the plug 216 can be removed from the exhaust port 138 to plug the intake port 137. That arrangement (not shown in FIG. 6A, 6B or 7) would establish the intake at the port 141 and the exhaust at the port 138. As noted above, with the configuration of the inlet valve 171 (FIG. 8A) and the exhaust valve 182 (FIG. 8B), the port 140*a* may also be used as an intake and/or the port 140*c* may be used as an exhaust. Further, the ports 140*b* may be used as an intake and/or the port 140*d* may be used as an exhaust (and vice versa is the positions of the valves 171, 182 are switched). Use of the ports 140*b*, 140*d* as the intake and exhaust may lower the profile of the compressor 120 when various plumbing accessories such as intake and exhaust filters and mufflers are attached. As an alternate construction (not shown) of valve plate body 23 used in the construction of compressor 20 (dual cylinder compressor), two valve plates 124 may have ports 140*b* and 140*d* modified to receive separate intake and exhaust chamber passageways of various construction methods, thereby providing communication between each valve plate. This alternate construction provides flexibility for future dual cylinder compressor configurations where a longer motor 53 with more power may be required to further expand the performance range of the compressor.

Figure 7:
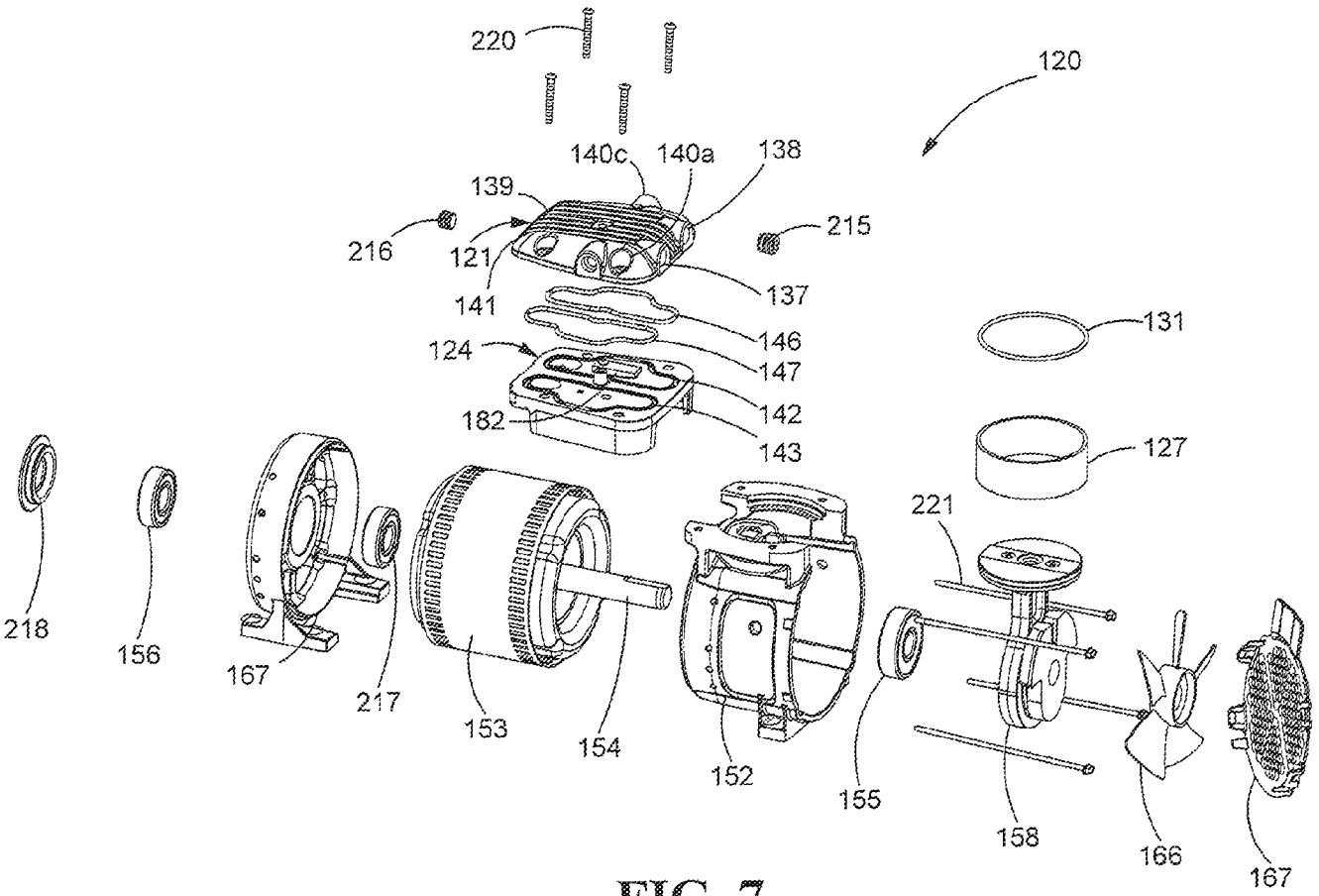
FIG. 7 an exploded view of the compressor shown in FIG. 6.
Figure 10B:
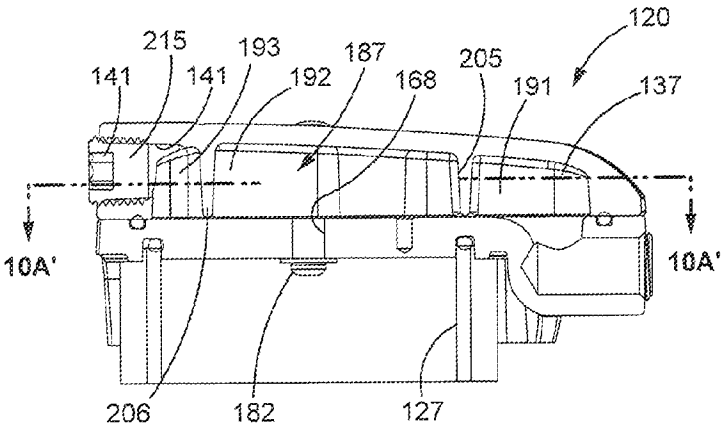
FIG. 10B is a sectional view taken substantially along line 10B-10B of FIG. 10A.
Figure 10C:
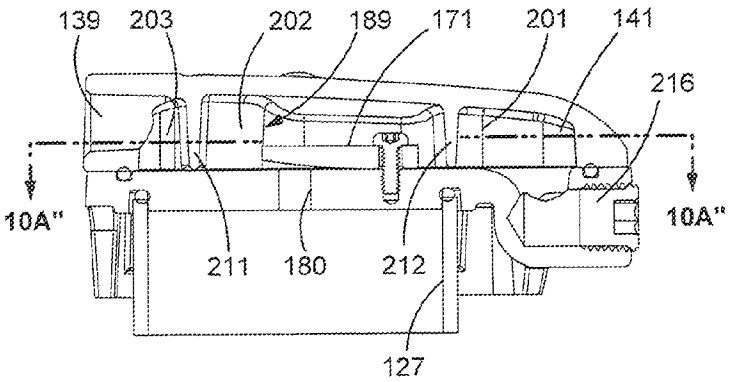
FIG. 10C is a sectional view taken substantially along line 10C-10C of FIG. 10A.
Figure 10A:
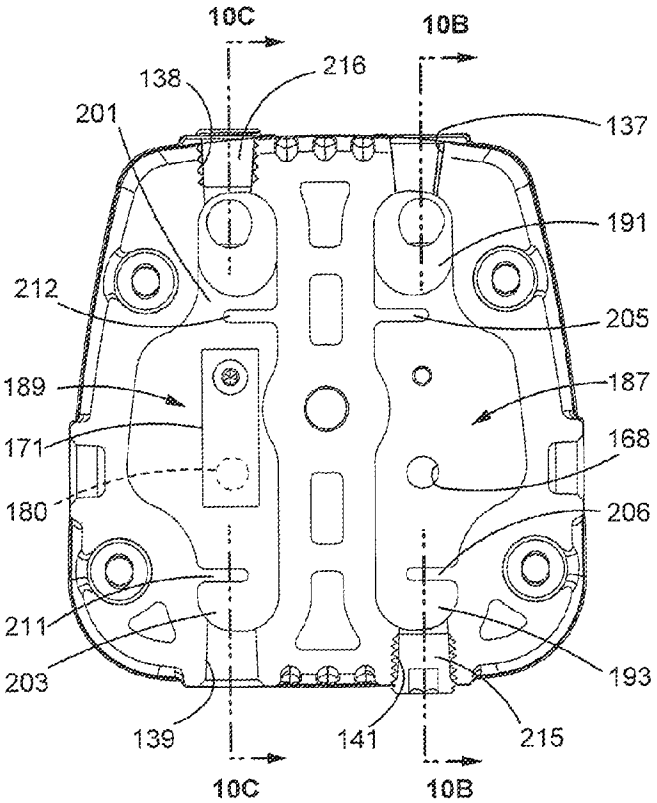
FIG. 10A is a sectional view taken substantially along lines 10A'-10A' of FIGS. 10B and 10A"-10A" of FIG. 10C.

Turning to FIG. 7, dedicated seals 146, 147 may be accommodated in the channels 142, 143 respectively for purposes of defining an intake chamber 187 and an exhaust chamber 189 and the related sound attenuation chambers 191, 193, 201, 203 (see FIGS. 10A-10C). Still referring to FIG. 7, the valve plate 124 may be used to cover a cylinder 127. An O-ring seal 131 may be sandwiched between the cylinder 127 and the underside of the valve plate 124. The compressor motor 153 may rotate a drive shaft 154, which may pass through a bearing 155 before it passes through the rocking piston assembly 158 and the fan 166. The drive shaft 154 may also pass through an additional ring 156 and a bushing 217. The motor may be partially accommodated in and supported by the main housing 152 and a ventilated end housing 167. A ventilated cover 166 may be coupled to the main housing 152 for purposes of protecting the fan 166. The bearing 166 may be covered by an end cap 218. Various fasteners are shown at 220, 221 for purposes of holding the compressor 120 together.

Figure 8B:
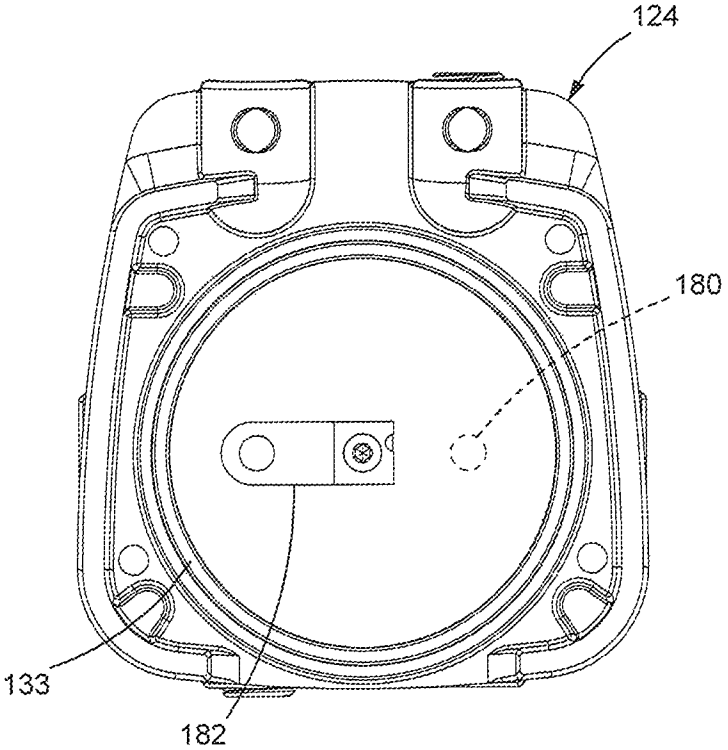
FIG. 8B is bottom view of the valve plate assembly of the compressor shown in FIGS. 6-7.
Figure 8A:
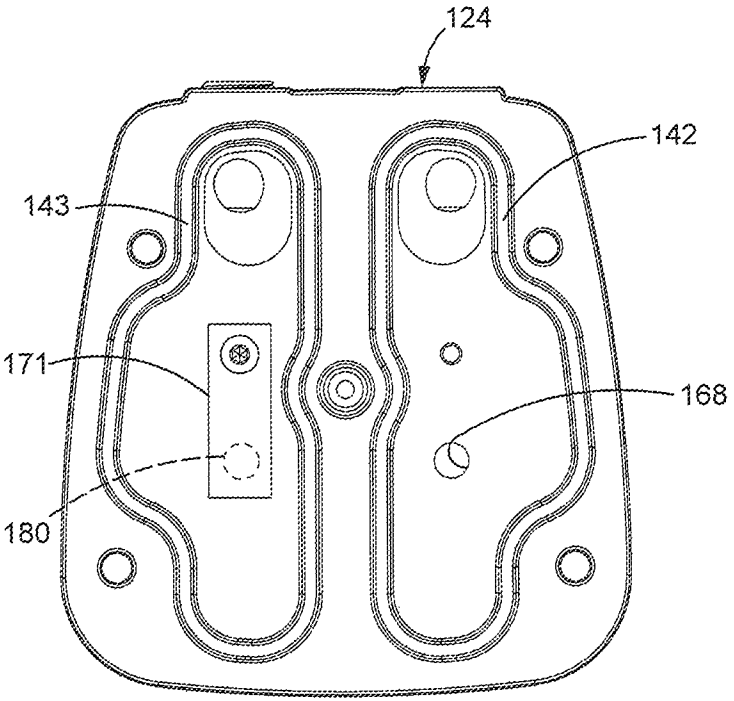
FIG. 8A is top view of the valve plate assembly of the compressor shown in FIGS. 6-7.

Turning to FIGS. 8A-8B, top and bottoms views of the valve plate 124 are shown. The valve plate 124 may include slots or grooves 142, 143 for purposes of accommodating the seals 146, 147 respectively (see FIG. 7). An exhaust valve 171 may cover an outlet 180. An intake valve 82 covers the underside of the inlet 168 shown in FIG. 8A while the exhaust valve 171 covers the upper side of the outlet 180. A slot or groove 133 accommodates the O-ring 131 shown in FIG. 7.

Figure 9:
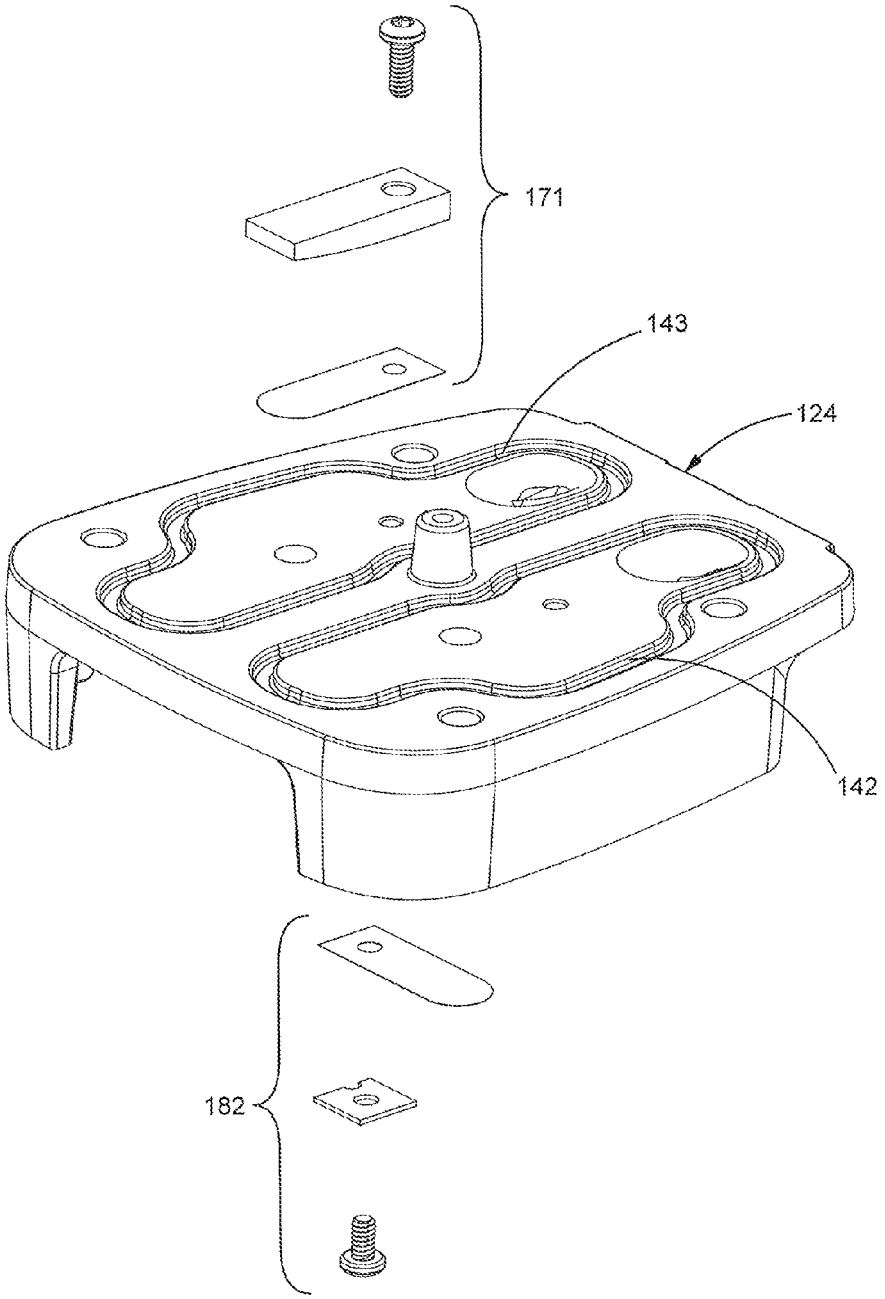
FIG. 9 is an exploded view of the valve plate assembly shown in FIGS. 8A and 8B.

FIG. 9 is an exploded view of the valve plate 124, exhaust valve 171, and intake valve 182. FIGS. 10A-10C illustrates the air/gas flow through the compressor 120. Air enters through the intake port 137 and passes into the intake chamber 187. The intake chamber 187 may be in communication with a plurality of sound attenuation chambers 191, 193. The sound attenuation chambers 191, 193 may be defined by the baffles 205, 206 as well as the head 121 and valve plate 124. Further, as discussed above in connection with the compressor 20 illustrated in FIGS. 1-5C, successive expansions and contractions of the volume or cross-sectional area through which the air/gas passes provides sound attenuation. Therefore, as air/gas enters the intake port 137, it expands into the sound attenuation chamber 191 before it is compressed again as it passes the baffle 205. The air/gas is then expanded again as it enters the large intake chamber 187. The gas/air exits the intake chamber 187 through the inlet 168 as it passes through the intake valve 182 (FIG. 10B). The sound attenuation chamber 193 and baffle 206 assists with sound attenuation, but also acts as a sound attenuation chamber when the additional port 141 is used as the intake.

Turning to FIG. 10C, air/gas exits the cylinder 127 through the outlet 180 and past the exhaust valve 171 before it enters the exhaust chamber 189. Similar to the intake chamber 187, the exhaust chamber 189 may be in communication with a plurality of sound attenuation chambers 201, 203 that may be defined by the baffles 211, 212, the head 121 and valve plate 124. As air/gas passes upward through the outlet 180 and past the exhaust valve 171, it expands into the large exhaust chamber 189. As the air/gas moves toward the exhaust port 139, it is compressed as it passes the baffle 211 before it is expanded again in the sound attenuation chamber 203 prior to exiting the compressor 120 through the exhaust 139. The baffle 212 and the sound attenuation chamber 201 provide sound attenuation benefits, but are used primarily when the additional port 141 serves as the exhaust.

Figure 11:
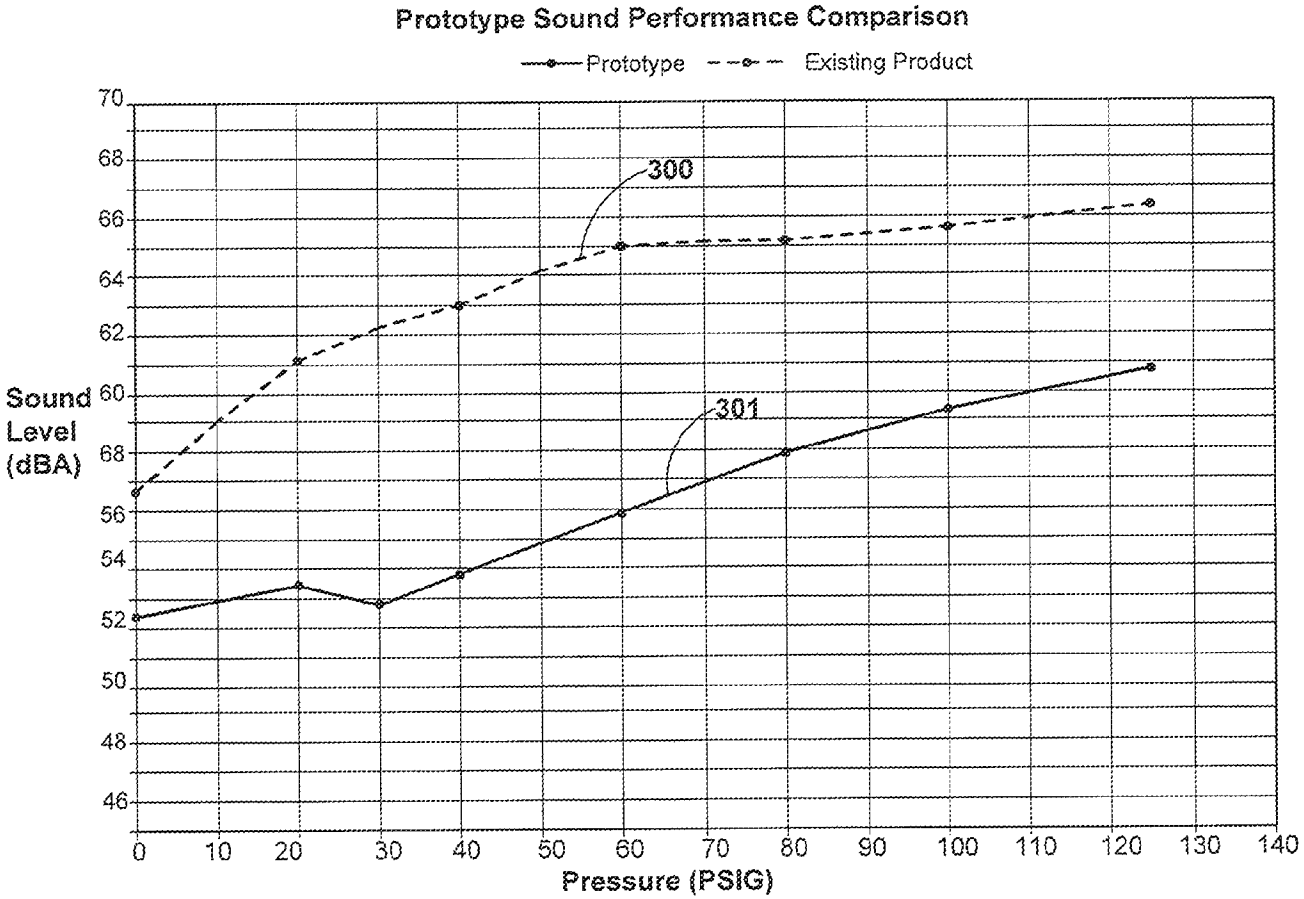
FIG. 11 graphically illustrates a sound performance comparison of the disclosed dual cylinder rocking piston compressor vs. a prior art dual cylinder rocking piston compressor.

As suggested above in regard to the compressor 20 of FIGS. 1-5C, without being bound by theory, it is believed that the successive expansions and contractions of the air or gas passing through the compressor 120 provides significant sound attenuation as graphically illustrated in FIG. 11 even though the curve 301 was generated with a dual rocking piston compressor 20 as opposed to a single cylinder rocking piston compressor 120.

INDUSTRIAL APPLICABILITY

Single cylinder and dual cylinder rocking piston compressors are disclosed with sound attenuation qualities. Air or gas enters the compressors through an intake port, which leads to an intake chamber. The intake chamber may be in communication with a plurality of sound attenuation chambers. By varying the cross-sectional area of the chambers along the flow path (i.e., changing the width of height of the chambers along the flow path) as well as by including baffles that may be perpendicular to the flow direction, significant sound attenuation is achieved. Further, the sound quality is improved as the disclosed compressors generate a more pleasing sound than that generated by currently available rocking piston compressors. The air or gas expands in an attenuation chamber before it is compressed as it moves past a baffle before it is expanded again in a successive sound attenuation chamber. The compression and expansion of the gas or air as it flows through the disclosed compressors is believed to provide the achieved sound attenuation effects. As the gas or air is expanded or contracted, its flow rate accelerates and decelerates thereby allowing sound energy to be dissipated. Additional sound attenuation chambers are provided by crossover passageways that have cross-sectional diameters that are greater than the inlets and outlets to the crossover passageways. Further, the intake chambers and exhaust chambers created by the valve plates and heads of the disclosed designs are isolated from one another by dedicated seals that reduce flow leakage even at higher pressures, thereby improving the efficiency of the disclosed single and double cylinder rocking piston type compressors.

Finally, the disclose compressors are capable of assuming multiple configurations, including low profile configurations and configurations which may permit the use of a larger motor. The flow direction of the compressors may be easily reversed.

What is claimed:

1. A rocking piston compressor comprising:

a valve plate covering a cylinder, the valve plate including an inlet and an outlet that are in communication with the cylinder;

a head coupled to the valve plate, the head and valve plate defining an intake chamber, two intake sound attenuation chambers, two intake baffles respectively comprising a partial wall with an opening, an exhaust chamber, two exhaust sound attenuation chambers and two exhaust baffles respectively comprising a partial wall with an opening, at least one of the head and valve plate defining a pair of intakes, at least one of the head and valve plate defining a pair of exhausts;

the intake chamber disposed between the pair of intakes with one of the two intake sound attenuation chambers disposed between the intake chamber and each intake, the intake sound attenuation chambers and the intake chamber being in communication with each other with one of two intake baffles disposed between each intake sound attenuation chamber and the intake chamber that restrict communication between the intake sound attenuation chambers and intake chamber, the inlet being disposed within the intake chamber and between the intake baffles;

the exhaust chamber disposed between the pair of exhausts with one of the two exhaust sound attenuation chambers disposed between the exhaust chamber and each exhaust, the exhaust sound attenuation chambers and the exhaust chamber being in communication with each other with one of two exhaust baffles disposed between each exhaust sound attenuation chamber and the exhaust chamber that restrict communication between the exhaust sound attenuation chambers and the exhaust chamber, the outlet being disposed within the exhaust chamber and between the exhaust baffles;

the intake chamber increasing in width as the intake chamber extends axially from the intake baffles and towards the inlet, the exhaust chamber increasing in width as the exhaust chamber extends axially from the exhaust baffles and towards the outlet;

the intakes and exhausts being threaded to receive a plug so only one intake and only one exhaust is open to the atmosphere at a time.

2. The compressor of claim 1 wherein the intakes pass through the valve plate.

3. The compressor of claim 1 wherein the exhausts pass through the valve plate.

4. The compressor of claim 1 wherein the intakes and exhausts pass through the valve plate.

5. The compressor of claim 1 wherein the intake and exhaust chambers are each circumscribed by chamber seals that are sandwiched between the valve plate and the head.

6. A rocking piston compressor comprising:

a valve plate body including two valve plates coupled together by an intake crossover passageway and an exhaust crossover passageway, the compressor including two cylinders with each valve plate covering one of the cylinders;

each valve plate including an inlet and an outlet in communication with its respective cylinder;

the compressor including two heads with each head covering one of the valve plates, each head and valve plate defining an intake chamber and an exhaust chamber, each intake chamber being in communication with the inlet of its respective valve plate, each exhaust chamber being in communication with the outlet of its respective valve plate;

the intake chambers being in communication with each other via the intake crossover passageway, the exhaust chambers being in communication with each other via the exhaust crossover passageway;

two intakes and two exhausts, the intakes and exhausts extending through either each head or each valve plate opposite the heads and valve plates from the intake and exhaust crossover passageways;

the intake crossover passageway including an inlet and an outlet and a passageway chamber disposed therebetween, the exhaust crossover passageway also including an inlet and an outlet and a passageway chamber disposed therebetween, a cross-sectional area of each of the passageway chambers between its respective inlet and outlet is greater than a minimum cross-sectional area at either its respective inlet or its respective outlet, each intake chamber disposed axially between a pair of intake sound attenuation chambers and a pair of intake baffles with one of the intake baffles disposed between each intake sound attenuation chamber and its respective intake chamber, each intake chamber being in communication with its pair of intake sound attenuation chambers with the intake baffles restricting communication between the intake sound attenuation chambers and their respective intake chamber, each exhaust chamber disposed axially between a pair of exhaust sound attenuation chambers and a pair of exhaust baffles with one of the exhaust baffles disposed between each exhaust sound attenuation chamber and its respective exhaust chamber, each exhaust chamber being in communication with its pair of exhaust sound attenuation chambers with the exhaust baffles restricting communication between the exhaust sound attenuation chambers and their respective exhaust chamber, each intake chamber increasing in width as each intake chamber extends axially from its respective intake baffles towards its respective inlet, each exhaust chamber increasing in width as each exhaust chamber extends axially from its respective exhaust baffles to its respective outlet;

each of the heads slopes towards its respective valve plate as it extends axially from one of the inlets and one of the outlets and towards the intake crossover passageway; and the intakes and exhausts being threaded to receive a plug so only one intake and only one exhaust is open to the atmosphere at a time.

7. The compressor of claim 6 wherein the intake and exhaust crossover passageways are disposed at least partially below the intake chambers and the exhaust chambers.

8. The compressor of claim 6 wherein each intake chamber is circumscribed by an intake chamber seal that is sandwiched between its respective valve plate and head; and each exhaust chamber is circumscribed by an exhaust chamber seal that is sandwiched between its respective valve plate and head.

* * * * *